United States Patent [19]

Ursino

[11] Patent Number: 5,038,413

[45] Date of Patent: Aug. 13, 1991

[54] SOCK FASTENING MEANS

[76] Inventor: Michael J. Ursino, 316 S. 3, Perkasie, Pa. 18944

[21] Appl. No.: 535,648

[22] Filed: Jun. 11, 1990

[51] Int. Cl.[5] ..... A41D 27/08; A44B 1/14; A44B 17/00

[52] U.S. Cl. ..... 2/239; 24/113 MP; 24/113 R

[58] Field of Search ..... 2/61, 239, DIG. 6; 24/108, 113 MP, 689, 690, 696

[56] References Cited

U.S. PATENT DOCUMENTS

| | | | |
|---|---|---|---|
| 2,099,979 | 11/1937 | Bangs | 24/113 MP |
| 2,509,501 | 5/1950 | Huelster | 24/690 |
| 2,624,091 | 1/1953 | Van Buren, Jr. | 24/690 X |
| 2,663,877 | 12/1953 | Bohman | 2/239 |
| 2,667,004 | 1/1954 | Sanson | 2/239 |
| 2,729,824 | 1/1956 | Doll, Jr. | 2/239 |
| 2,851,756 | 9/1958 | Jones | 24/696 X |
| 2,906,045 | 9/1959 | Stein | 24/113 MP |
| 3,001,203 | 9/1961 | Hassler | 2/239 |
| 3,466,714 | 9/1969 | Nysten | 24/689 |
| 3,500,507 | 3/1970 | Malhenzie et al. | 24/113 MP |
| 3,538,557 | 11/1970 | Hirose | 24/696 |
| 4,044,433 | 8/1977 | Aureli | 24/690 |
| 4,106,126 | 8/1978 | Treankle | 2/DIG. 6 X |
| 4,165,555 | 8/1979 | Boxer et al. | 2/DIG. 6 X |
| 4,422,186 | 12/1983 | Loney | 2/114 |

*Primary Examiner*—Werner H. Schroeder
*Assistant Examiner*—Jeanette E. Chapman
*Attorney, Agent, or Firm*—Joseph W. Molasky & Assocs.

[57] ABSTRACT

A fastening device for securing a pair of socks together includes a first fastener attached to one sock of the pair and a second fastener attached to the other sock of the pair, said fasteners being releasably engageable with one another. The fastening device prevents the loss of socks due to separation from one another and the inconsistent pairing of socks of a similar type.

8 Claims, 2 Drawing Sheets

FIG. 1
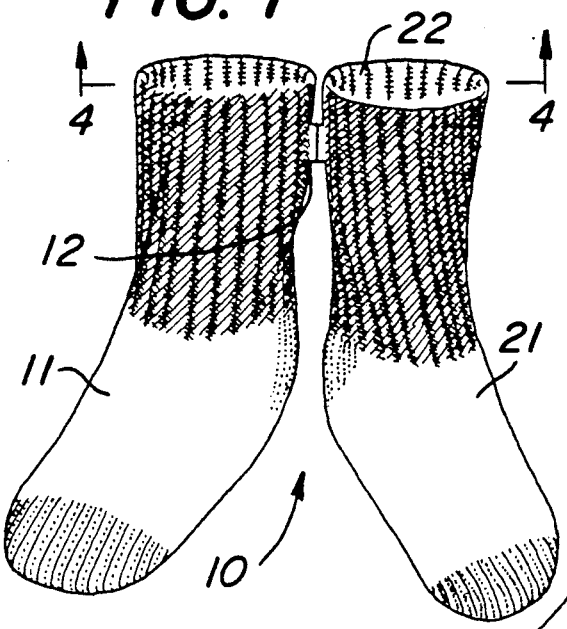
FIG. 2
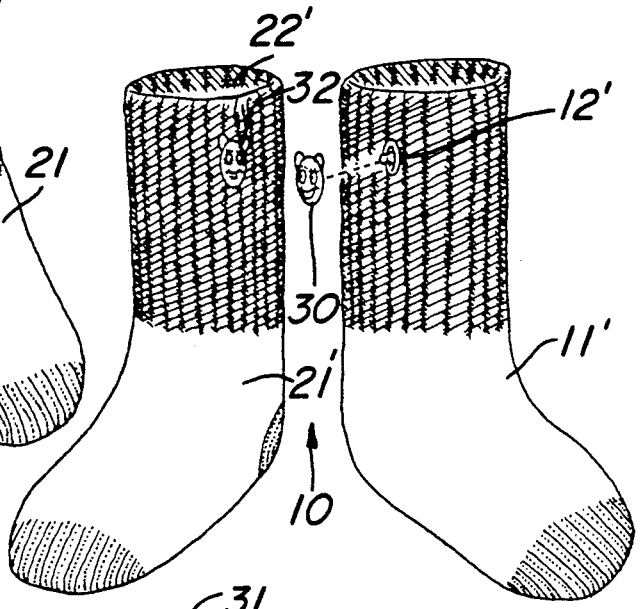
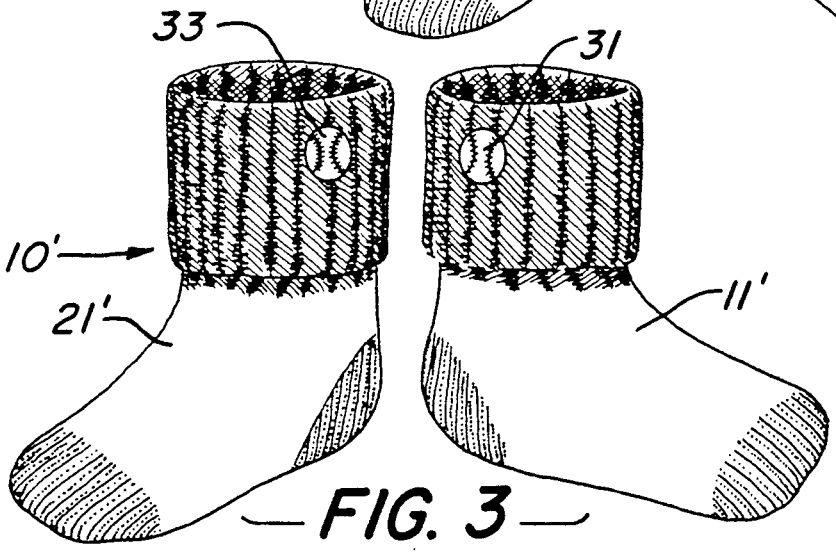
FIG. 3
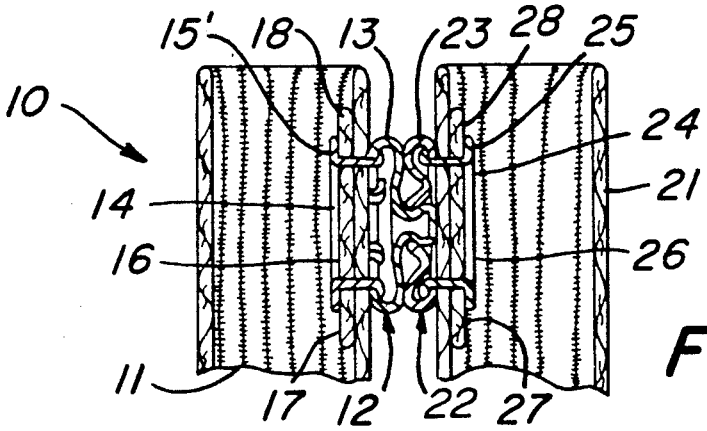
FIG. 4

FIG. 5
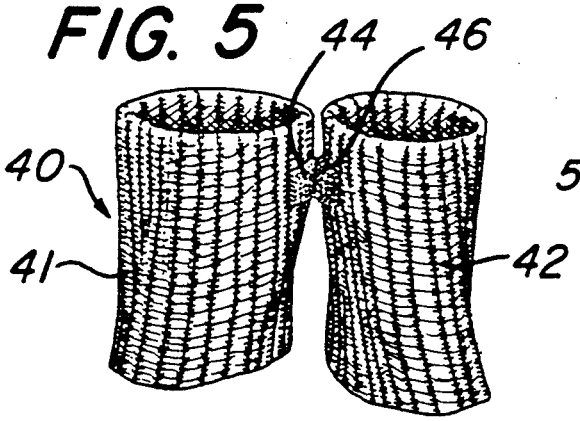
FIG. 6
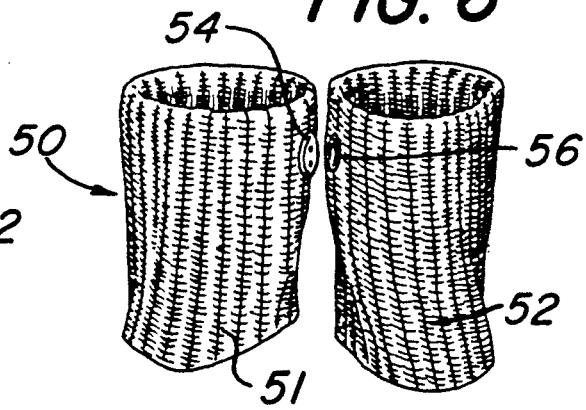
FIG. 7
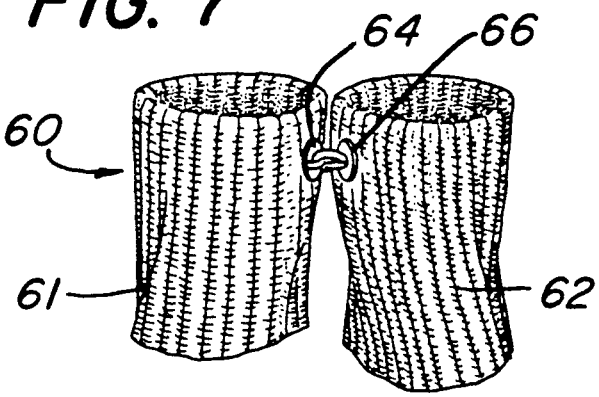
FIG. 8
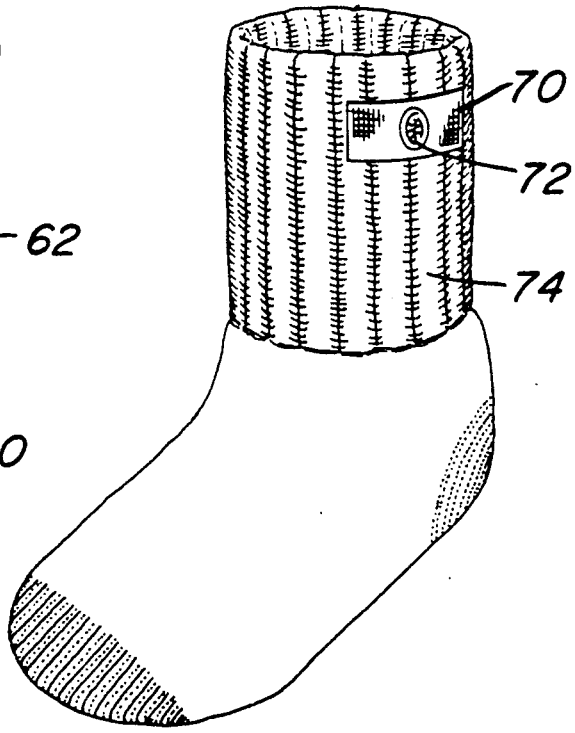
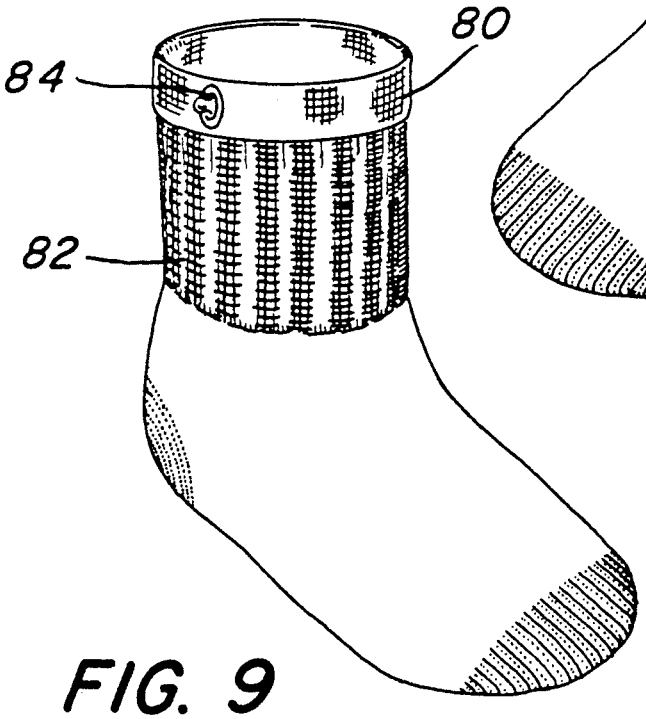
FIG. 9

SOCK FASTENING MEANS

BACKGROUND AND SUMMARY OF THE INVENTION

Over the years there have been several problems involving the use, care and handling of socks. One problem is the loss of individual socks due to separation before, during and after the washing and drying of the socks. Another problem is the inconsistent pairing of socks which have small differences in their tone, age, color or type. As a result, a substantial amount of time is spent locating, sorting and pairing socks which have been scrambled together during handling or when not in use.

As to the prior art, there has been in use a plastic snap-like fastening means for use in securing a pair of socks together. However, this fastening means is not entirely satisfactory since the plastic snap members are ineffectively attached to the socks, become worn during use, and are subject to deterioration when subjected to high temperatures. As a result, the snap members often become inoperative.

It is the general object of this invention to provide a fastening means for socks which assures the most convenient and permanent means to keep a pair of socks together when they are not being worn. To this end, the socks are provided with permanently attached fastening means which take various forms and which are designed to provide a good, reliable fastening action as well as a decorative appearance.

In accordance with the general object of the invention there is provided various types of fastening means including a snap fastener, a button-hole fastening means, a Velcro-type fastener and a hook type of fastener. Furthermore, the fastening means in accordance with the invention is provided with a reinforcement material which provides added strength to the sock for the snap application and use. In accordance with a further object of the invention the snap fasteners are provided with covers which can be used to provide a decorative appearance to the fastening means in use. In accordance with a further feature of the invention there is provided a patch having a snap fastener secured thereto, said patch being adapted to be ironed or sewn to the outside of the sock and designed to reinforce the sock material. In accordance with a further feature of the invention there is provided a reinforcement band that has a snap fastener attached thereto and is attached to the upper end of the leg portion of the sock.

The fastening means in accordance with the invention has many advantages and features. Thus, in addition to being very convenient, the fastening means in accordance with the invention stay engaged to secure the socks together from the time they are removed by the wearer until the time they are to be worn again. Further, the fastening means can be used by everyone, including adults and children. Further, the socks in accordance with the invention can be hung on a closeline to dry without the use of closepins. Further, the socks provided with the fastening means of the invention will be inexpensive to make by the manufacturer and will, therefore, be reasonably priced for the consumer.

BRIEF DESCRIPTION OF THE DRAWINGS

FIG. 1 is a view showing a pair of socks provided with fastening means in accordance with the invention, the socks being shown secured together by the fastening means.

FIG. 2 is a view showing another pair of socks illustrating a feature of the invention.

FIG. 3 is a view showing the pair of socks shown in FIG. 2 folded down in a bobbysocks style to illustrate another feature of the invention.

FIG. 4 is an enlarged sectional view taken generally on FIG. 4—4 of FIG. 1.

FIG. 5 is a view showing another embodiment of the invention wherein the fastening means comprises Velcro-type fasteners.

FIG. 6 is a view of still another embodiment of the invention wherein the fastening means comprises a button and a button hole.

FIG. 7 is a view showing another embodiment of the invention wherein the fastening means comprises a hook and an eyelet.

FIG. 8 is a view of a sock showing another embodiment of the invention wherein a fastening member is secured to a patch.

FIG. 9 is a view of a sock showing another embodiment of the invention wherein a fastening member is secured to a band which is attached to the upper end of the sock.

DETAILED DESCRIPTION OF THE PREFERRED EMBODIMENTS

In FIGS. 1 and 4 there is shown an embodiment of the invention comprising a pair of socks 10 including a first sock 11 and a second sock 21 secured together by a snap-type of fastening means. The snap-type fastening means includes a first fastener 12 having a generally circular part 13 providing a projection and a second fastener 22 having a generally circular part 23 providing a hole, said projection fitting into said hole with a snap-like fit. As shown in FIG. 1, fasteners 12 and 22 are located on corresponding places of the leg portion of socks 11 and 21, respectively. The snapped together condition of the fasteners 12 and 22 is shown in detail in FIG. 4 which shows that projection providing part 13 and the hole providing part 23 are located on the outside of the leg portion of socks 11 and 21, respectively.

Means are provided for attaching fastener 12 to sock 11 on the leg portion thereof with fastener part 13 located on the outside of said leg portion. Such means comprises a retainer part 14 of fastener 12 which has a generally annular configuration and includes a rim 15 and a plurality of circumferentially spaced, axially extending ribs 16 constructed and arranged to extend through the sock 11 to engage a rim portion 17 of fastener part 13 in an arrangement as shown in FIG. 4.

In accordance with a feature of the invention, there is provided a piece of reinforcement material 18 positioned between rim 15 and the inside wall of sock 11. The reinforcement material 18 serves to strengthen the sock 11 in the area where the snap fastener part 14 is located and where a substantial force is applied during use.

Means are provided for attaching fastener 22 to sock 21 on the sock's leg portion at a location corresponding to fastener 12 and with the part 23 located on the outside of the sock. Such means comprises a retainer part 24 of fastener 22 which has a generally annular configuration and includes an annular rim 25 and a plurality of circumferentially spaced, axially extending ribs 26 constructed and arranged to extend through the sock 21 to engage a rim portion 27 of fastener part 23 in an arrangement as shown in FIG. 4.

In accordance with a feature of the invention, there is provided a piece of reinforcement material 28 positioned between rim 25 and the inside wall of sock 21. Reinforcement material 28 serves to strengthen the sock 21 in the area where the snap fastener part 24 is located and where a substantial force is applied during use.

In FIGS. 2 and 3 there is shown another embodiment of the invention wherein a pair of socks is provided with fastening means similar to that shown in the FIG. 1 embodiment and provided with covers to present a decorative appearance. Since the embodiment of the invention shown in FIGS. 2 and 3 comprises similar parts to that shown in FIG. 1, corresponding parts have been given the same reference numerals with primes added. Thus, this embodiment comprises a pair of socks 10' including a first sock 11' and a second sock 21' secured together by a snap-type of fastening means including a first fastener 12' and a second fastener 22' constructed in a manner similar to fasteners 12 and 22, respectively, as described above. In accordance with a feature of the invention, there is provided a first cover member 30 having a hole providing portion and adapted to be snapped onto the projection of the first fastener 12' and a second cover member 32 having a projection adapted to be snapped into the hole of said second fastener 22'. These covers 30 and 32 are provided on their outer surfaces with similar "bear" designs. Thus, not only do the covers 30 and 32 provide a decorative appearance but also they may be relied on to indicate that the two socks 11' and 21' form part of a pair. As shown in FIG. 3, there is also provided a second pair of covers 31 and 33 which have a "baseball" design on the outer surface thereof, said covers 31 and 33 being secured to the annular rims of the retainer parts of the fasteners 12' and 22' so that when the socks 11' and 21' are turned down to a bobbysocks style, as shown in FIG. 3, said covers 31 and 33 will present a decorative appearance as well as providing an indication that the two socks 11' and 21' form part of a pair.

In FIG. 5 there is shown another embodiment of the invention wherein the fastening means comprises a hook and loop fastener of the "Velcro" type. To this end, a pair of socks 40 include a first sock 41 and a second sock 42 provided with the "Velcro" type fastener wherein a hook means 44 including many small hook members is attached to sock 41 and a loop means 46 including many small loops is attached to sock 42. The small loops of loop means 46 are adapted to be engaged by said hook members of hook means 44.

In FIG. 6 there is shown an embodiment of the invention wherein the fastening means is comprised of a button and button hole arrangement. To this end, a pair of socks 50 including a first sock 51 and a second sock 52 is provided. Sock 51 is provided with a fastener in the form of a button 54 sewed thereto on the outside near the leg portion thereof. Likewise, sock 52 is provided with a buttonhole 56 located on the leg portion thereof at a place corresponding to the location of the button 54 on sock 51. Buttonhole 56 is constructed and arranged to be releasably engagable with button 54.

In FIG. 7 there is shown another embodiment of the invention wherein the fastening means is comprised of a simple hook construction. Thus, a pair of socks 60 includes a first sock 51 and a second sock 52 secured together by a simple hook and eyelet fastening arrangement in accordance with the invention. The fastening means comprises a first fastener 64 in the form of a single hook providing a fastener part secured on the outside of the leg of sock 61. The sock 52 is provided with a second fastener 66 having means providing an eyelet adapted to be engaged by the hook of fastener member 64.

In FIG. 8 there is shown another type of means for securing a fastener to a sock. In accordance with this embodiment, there is provided a patch 70 having a fastener 72 secured thereto. Patch is adapted to be secured to the outside of a sock 74 in a manner as shown in FIG. 8.

In FIG. 9 there is shown another type of means for securing a fastener to the sock. As shown in FIG. 9, this means comprises a band 80 which extends around the upper end of the sock 82 and is sewn thereto. The band 80 has a fastener 84 attached thereto in a suitable manner and in an arrangement as shown in FIG. 9. The band 80 provides a reinforcement for providing additional support for the sock 82 and the fastener 84 attached thereto.

It will be apparent that various changes may be made in the construction and arrangement of parts without departing from the scope of the invention. Thus, various ones of the above-described alternate embodiments of the invention may be used with various other ones. Further, the various covers shown may take various decorative designs and can be worn to accent any wardrobe. In fact, they can be mixed and matched with different colors, shapes and styles and between different socks if so desired. Also, the various covers and patches and bands may be made to blend with the color and/or texture of the sock and, they may be applied at locations where people would not like the snap to be apparent.

What is claimed is:

1. In combination, a pair of socks, and a snap type of fastening means for securing said pair of socks together to prevent the separation thereof during storage, washing, drying or the like, said fastening means including a first fastener having a part providing a projection, means for attaching said first fastener to one of said pair of socks, a second fastener having a part providing a hole, and means for attaching said second fastener to the other of said pair of socks, said first and second fasteners being constructed and arranged to be releasably engagable with one another with said projection fitting into said hole with a snap-like fit, said first and second fasteners being made of a non-corrosive, heat-resistant material, a first cover member having a hole providing portion adapted to be snapped onto said projection of said first fastener and a second cover member having a projection adapted to be snapped into said hole of said second fastener.

2. The combination according to claim 1 wherein said projection providing part of said first fastener is located on one side of said one sock, said first fastener having a retainer part located on the other side of said one sock, said hole providing part of said second fastener being located on one side of said other sock, said second fastener having a retainer part located on the other side of said other sock, a first piece of reinforcement material positioned between said retainer part of said first fastener and said one sock, and a second piece of reinforcement material located between the retainer part of said second fastener and said other sock, and said reinforcement material providing added strength to the attachment of said first and second fasteners to said associated socks.

3. The combination according to claim 1 wherein the outer surfaces of said first and second cover members are provided with a similar design on the outer face thereof.

4. The combination according to claim 3 wherein said projection and hole providing parts of said first and second fasteners are arranged to face outwardly from the outer side of the leg of each sock.

5. The combination according to claim 1 wherein said projection and hole providing parts of said first and second fasteners are designed to face outwardly from the outer side of the legs of each sock.

6. The combination according to claim 1 wherein each of said means for attaching said first and second fasteners to said pair of socks comprises a patch having a fastener secured thereto, each patch being adapted to be secured to the outside of an associated sock.

7. The combination according to claim 1 wherein each of said means for attaching said first and second fasteners to said pair of socks comprises a band extending around the upper end of an associated sock and sewn thereto.

8. The combination according to claim 1 wherein said projection providing part of said first fastener is located on one side of said one sock, said first fastener having a retainer part located on the other side of said one sock, said hole providing part of said second fastener being located on one side of said other sock, said second fastener having a retainer part located on the other side of said other sock, and including a decorative cover attached to each of said retainer parts of said first and second fasteners.

* * * * *